US006729536B2

(12) United States Patent
Davignon, II

(10) Patent No.: US 6,729,536 B2
(45) Date of Patent: May 4, 2004

(54) COMBINATION GOLF BALL MARKER AND STROKE INDICATOR DEVICE

(76) Inventor: Robert W. Davignon, II, 4450 S. Willowbrook Ct., Terre Haute, IN (US) 47802

( * ) Notice: Subject to any disclaimer, the term of this patent is extended or adjusted under 35 U.S.C. 154(b) by 89 days.

(21) Appl. No.: 10/090,130

(22) Filed: Mar. 5, 2002

(65) Prior Publication Data

US 2003/0066874 A1 Apr. 10, 2003

Related U.S. Application Data

(60) Provisional application No. 60/326,702, filed on Oct. 4, 2001.

(51) Int. Cl.[7] ..... G06C 27/00

(52) U.S. Cl. ..... 235/78 G; 235/78 R; 235/77; 235/88 G

(58) Field of Search ..... 235/78 R, 88 R, 235/77, 78 A, 78 F, 78 G, 78 M, 78 N, 78 RC, 83, 88 F, 88 G, 88 M, 88 N, 88 RC

(56) References Cited

U.S. PATENT DOCUMENTS 2,485,191 A * 10/1949 Culver ..... 235/83
3,106,030 A * 10/1963 Pelosi ..... 40/495
3,363,836 A * 1/1968 Lee ..... 235/78 R
3,627,200 A * 12/1971 Sadler ..... 235/88 G
3,847,110 A 11/1974 Inoue
4,137,448 A * 1/1979 Smith ..... 235/78 G
4,998,726 A 3/1991 Budnick
5,419,551 A * 5/1995 Hoyt et al. ..... 473/406
5,481,093 A * 1/1996 Rogerson ..... 235/78 R
5,730,658 A 3/1998 Kurtz et al.
5,769,740 A * 6/1998 Colangelo ..... 473/408
6,394,916 B1 * 5/2002 Doucettperry ..... 473/406
6,569,040 B2 * 5/2003 Bradstock ..... 473/707

* cited by examiner

*Primary Examiner*—Karl D. Frech

(57) ABSTRACT

A combination ball marker and stroke indicator device (10,20) has a first disc member (12,22) having a ground piercing pin (12*b*,22*b*) extending from a bottom face surface rotatably received through a pin receiving aperture (14*a*, 24*a*) in a second disc member (14,24). Stroke indicating indicia (14*b*) are arranged on the top face surface of the second disc member and selectively alignable with a window (12*a*,22*a*) formed in the first disc member. A ground traction surface configuration (24*e*,24*e*′,24*e*″) is preferably formed on the bottom face surface of the second disc member. An annular recess (22*d*) may be formed in one of the disc members, for example, in the bottom face surface of the second disc member, to provide clearance between the indicia on the second disc member and the facing surface of the first disc member.

19 Claims, 4 Drawing Sheets

COMBINATION GOLF BALL MARKER AND STROKE INDICATOR DEVICE

RELATED APPLICATIONS

Priority is claimed from provisional application No. 60/326,702, filed on Oct. 4, 2001.

FIELD OF THE INVENTION

This invention relates generally to the game of golf and more particularly to accessories for use in playing the game.

BACKGROUND OF THE INVENTION

U.S. Pat. No. 4,998,726 shows and describes a device having a two-piece case for holding various golf related accessories including a conventional ball marker, a circular rotatable stroke counter and other items. The ball marker has a pin removably received in an aperture of the case and is removable to enable a user to mark the position of a ball. The stroke counter comprises a wheel received in an arcuate recess of the case and is provided with a centrally located stem received in an indent in the arcuate recess. The wheel projects from the housing so that it can be rotated in order that a numeral reflecting the stroke count of a user can be displayed in a window of the case. An eyelet is provided on the case for attachment to a key chain or golf bag.

In U.S. Pat. No. 3,847,110, a rotatable disc bearing scoring numbers on a face surface around its periphery is received on a first member of a hook and pile fabric combination. A friction disc having a roughened surface is attached to the rotatable disc by a short shaft which goes through an opening in the first member so that the rotatable disc is on a smooth side of the first member and the friction disc is on the hook and pile surface. A second hook and pile fabric is permanently attached to a golf glove and frictionally receives the first member thereon with the rotatable disc being rotatable so that a selected score numeral can be aligned with an arrow provided on the smooth side of the first fabric member adjacent to the rotatable disc.

In U.S. Pat. No. 5,730,658, a rotary numbered disc is held in place between top and bottom portions of a base by a lug pivotably mounted in a hole in the bottom portions of the base. The top portion of the base has a cut-away portion exposing part of the rotary disc to enable rotation of the disc to expose a selected stroke number in a window formed in the top portion of the base. The device is attached to a fastening band of a glove utilizing hook and loop material.

As shown in the above patents, it is known to attach a rotatable stroke indicator to a golf glove or to a case housing a variety of accessories. However, when approaching a green, bags are left off the green and many golfers remove their golf glove to enhance their feel for putting strokes making it awkward for use of the stroke indicator. As a result, the above patents have limited applicability.

SUMMARY OF THE INVENTION

An object of the present invention is the provision of an improved golf accessory for tracking golf strokes. Another object is the provision of a golf stroke indicator which is simple, inexpensive and compact. Yet another object of the invention is the provision of a golf stroke indicator that can be readily and unobtrusively carried on one's person without calling attention to oneself in the manner of a device attached to one's glove.

Briefly, in accordance with the invention, a ball marker having a ground piercing pin attached to a first generally flat, thin disc member is provided with an indicia exposing window on its face surface near the outer periphery thereof with a second apertured, generally flat, thin disc member received under the first disc member with the pin received through the aperture of the second disc member. A series of stroke indicating indicia, e.g., numerals, are formed on the top face surface of the second disc member. Preferably, a selected ground traction or friction means is formed on the bottom face surface of the second disc member. The ground piercing pin is cylindrical and the aperture of the second disc member is formed to provide a close fit, preferably an interference fit for the pin. An annular recess may be formed in one of the interfacing surfaces of the disc members aligned with the indicia to provide clearance for the indicia. Preferably, the first and second disc members are circular with the first disc member having a slightly larger diameter than that of the second disc member and the outer peripheral edge of at least the second disc member preferably being formed with a tapered surface with the diameter decreasing as one goes in the direction from the top or interface surface to the bottom or ground engaging surface. The window may be of any desired shape such as circular or arcuate.

BRIEF DESCRIPTION OF THE DRAWINGS

Other objects and features of the invention will become apparent by reference to the following detailed description of preferred embodiments of the invention when considered in connection with the accompanying drawings wherein.

DESCRIPTION OF PREFERRED EMBODIMENTS

Figure 1:
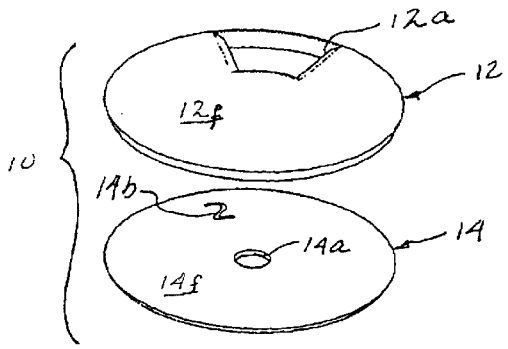
FIG. 1 is a blown apart perspective view showing the top surface of first and second disc members of a combination ball marker and stroke indicator device made in accordance with a first preferred embodiment of the invention.
Figure 1A:
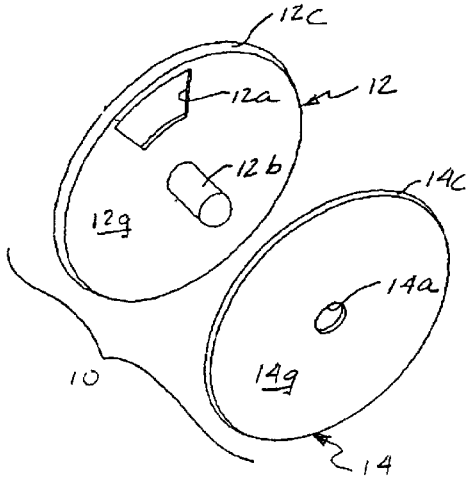
FIG. 1*a* is similar to FIG. 1 but shows the bottom surface of the first and second disc members.
Figure 1B:
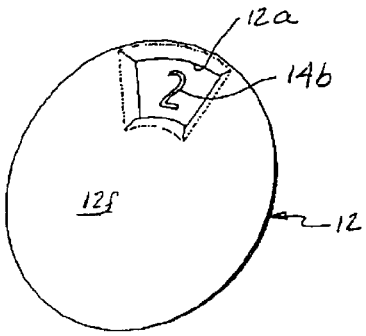
FIG. 1*b* is a perspective view showing the top surface of an assembled FIG. 1 device.
Figure 1C:
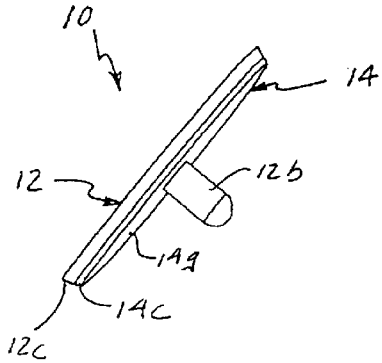
FIG. 1*c* is a side view of the FIG. 1*b* device, slightly tilted to show the bottom surface of the second disc member.

Turning to FIG. 1, a first embodiment of the invention comprises a combination ball marker and scorer or stroke indicator device 10 having a first generally flat, thin disc member 12, preferably circular in configuration, formed with a window 12*a* therethrough. The window shown is arcuate but could be of any desire shape, such as circular as shown in FIGS. 2*b*, 2*c* to be discussed. The first disc member has a centrally located ground piercing pin 12*b* depending from the lower surface 12*g* of the disc member. A second generally flat, thin, preferably circular disc member 14 having a centrally located pin receiving hole 14*a* is receivable on the bottom surface of the first disc member 12 with pin 12*b* received through pin receiving hole 14*a* for rotatable movement of the disc members relative to one another. Hole 14*a* and pin 12*b* are sized to provide a tight, preferably interference fit. A series of indicia 14*b*, e.g., numerals for indication the number of strokes taken on a hole, is arranged on the top face surface of the second disc member along the outer periphery thereof and alignable with window 12*a*. An inwardly extending taper 12*c* is formed on the outer periphery of first disc member 12, that is, with the diameter of the disc decreasing in the direction going from the upper face surface 12*f* to the lower face surface 12*g*. Second disc member 14 preferably is formed with a similar inwardly extending taper on its outer peripheral edge from a diameter on face surface 14*f* equal to or slightly less than the diameter of face surface 12*g* of first disc member 12 to a still smaller diameter on face surface 14*g*. The tapers facilitate gripping the first disc member for rotation thereof relative to the second disc member.

In use, the combination marker/stroke indicator device is placed with pin 12*b* inserted into the ground on a green to mark the position of a ball in a conventional manner and first disc member 12 is turned relative to second disc 14 until the desired stroke indicia reflective of a user's score at that time is seen through the window. The user is then free to concentrate on planning for his/her upcoming putt once his/her turn has arrived without having to bother about having to remember the number of strokes taken to that point.

With particular reference to FIGS. 2, 2*a*, 4 and 5, a modified embodiment 20 is shown in which disc member 22 has a window 22*a* and a downwardly depending pin 22*b* as in the previously described embodiment but further includes an annular recess 22*d* aligned with indicia (not shown) formed on disc member 24, having a width sufficient to extend beyond the top and bottom of the indicia, to provide clearance between the indicia and disc member 22. The outer peripheral edge surface of disc member 22 is shown with no taper while disc member 24 is preferably formed with a diameter equal to or less than the first disc member (the diameter of the second disc member shown in FIGS. 2, 2*a* as being slightly less than the diameter of the first disc member) and is also preferably provided with a downwardly, inwardly extending taper of decreasing diameter relative to a direction going from upper face surface 24*f* to lower face surface 24*g* to facilitate gripping of first disc member 22 for rotation relative to second disc member 24.

Figure 2:
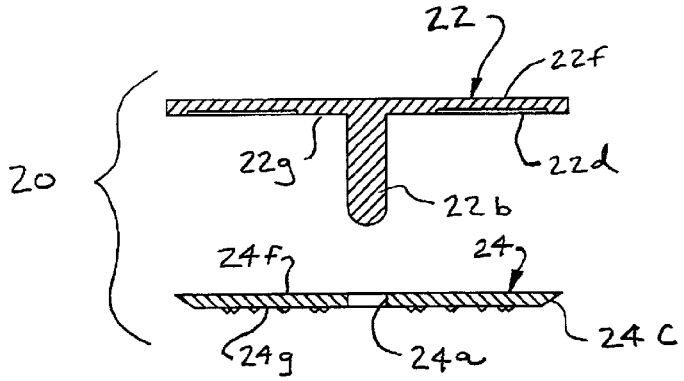
FIG. 2 is a blown apart elevational cross sectional view of a modified embodiment.
Figure 2B:
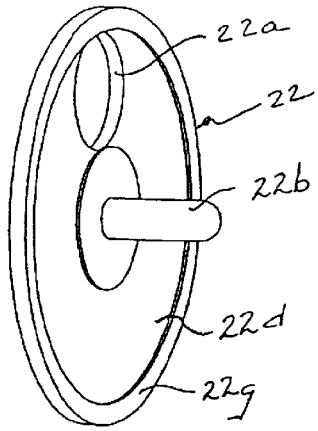
FIG. 2*b* is a perspective view showing the bottom surface of the first disc member of the FIG. 2 device.
Figure 2A:
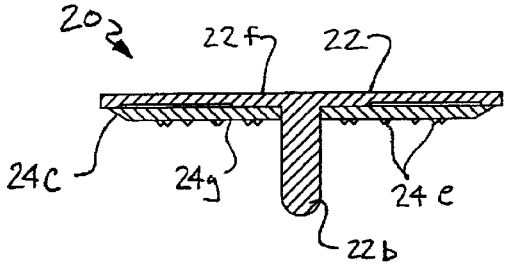
FIG. 2*a* is a view similar to FIG. 1 of an assembled device according to the modified embodiment.
Figure 2C:
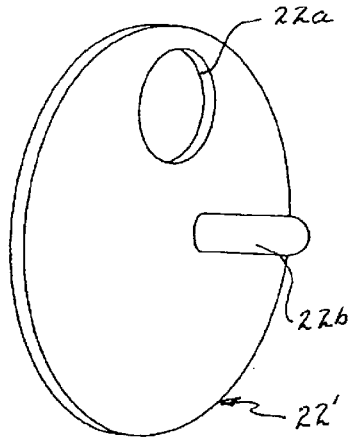
FIG. 2*c* is a view similar to FIG. 2*b* but of a modified first disc member.
Figure 2D:
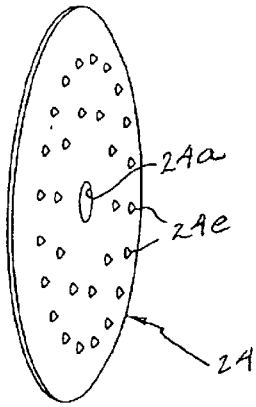
FIG. 2*d* us a perspective view showing the bottom surface of the FIG. 2 second disc member.
Figure 2E:
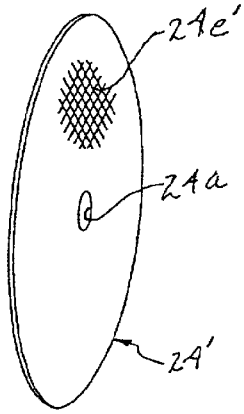
FIG. 2*e* is a view similar to FIG. 2*d* but showing a modified second disc member.
Figure 3:
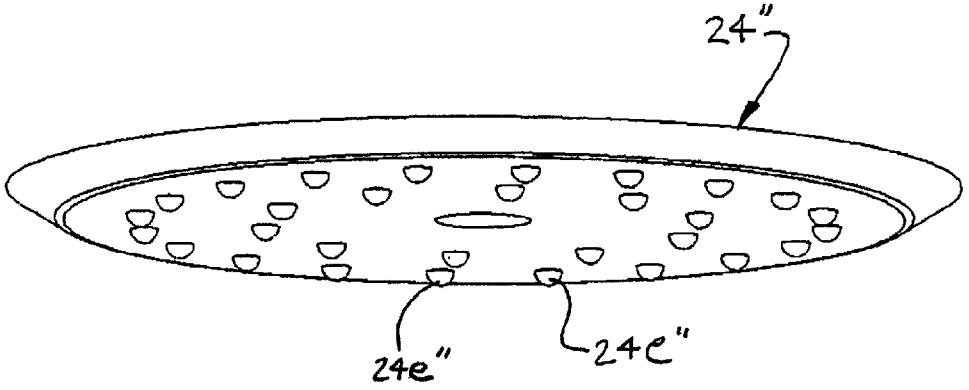
FIG. 3 is an enlarged perspective view showing the bottom surface of a second disc member having rounded ground engaging bottom surface projections and FIG. 3*a* is a cross sectional view taken through one of the projections of FIG. 3.
Figure 3A:
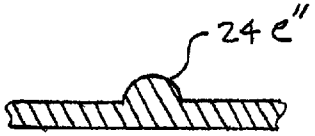
Figure 4:
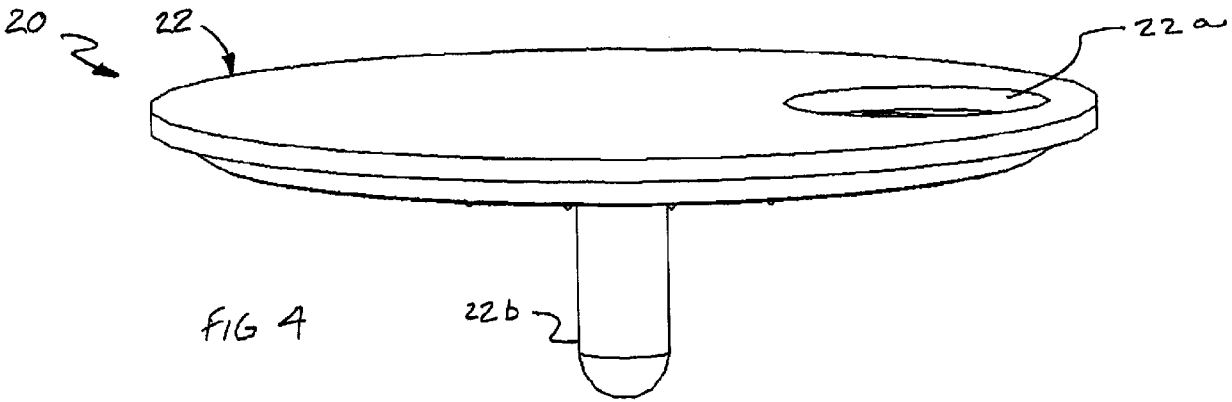
FIG. 4 is an enlarged perspective view of an assembled device of the type shown in FIG. 2*a* taken from above the device.
Figure 5:
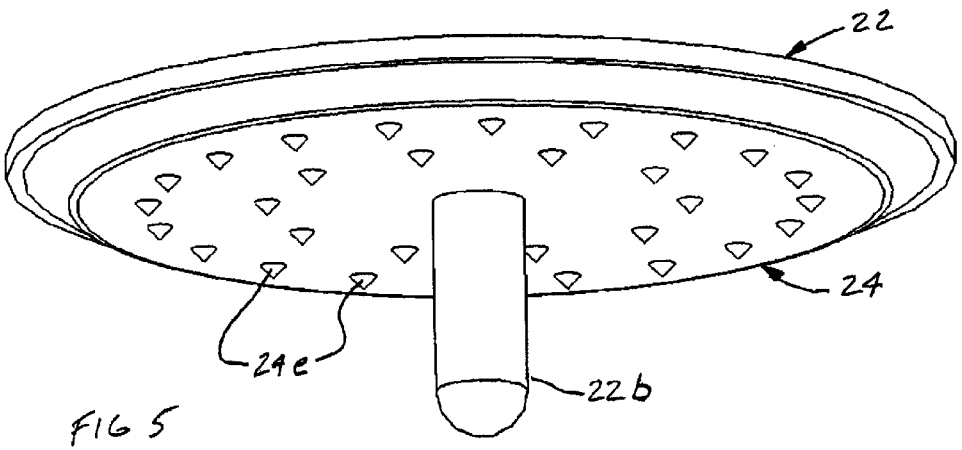
FIG. 5 is an enlarged perspective view, similar to FIG. 4 but taken from below the device.

Another modification of the FIGS. 2, 2*a* embodiment is the provision of ground traction means on the bottom surface 24*g* of second disc member 24. As shown in FIGS. 2, 2*a* and 2*d*, the ground traction means can be in the form of knobs 24*e* extending downwardly from the bottom surface 24*g* to provide traction with the ground and easier rotation of the first disc member 22 relative to the second disc member 24. The surface configuration can be of various forms such as generally conical knobs forming points, as shown at 24*e*, knurled as indicated at 24*e'* in FIG. 2*e* or rounded knobs as shown at 24" in FIGS. 3, 3*a*.

Figures 2F, 2G, 2H:
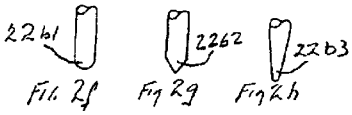
FIGS. 2*f*–2*h* show alternative distal end configurations of the ground piercing pin of the first disc member.

With reference to FIGS. 2*f*–2*h*, pin 22*b* can be formed with any desired distal end configuration including rounded distal end 22*b*1 of FIG. 2*f*, pointed distal end 22*b*2 of FIG. 2*g* and tapered distal end 22*b*3 of FIG. 2*h*.

Although the invention has been described with regard to specific preferred embodiments thereof, variations will become apparent to those skilled in the art. It is, therefore, the intent that the appended claims be interpreted as broadly as possible in view of the prior art to include ass such variations and modifications.

What is claimed:

1. A combination ball marker and stroke indicator device comprising a first thin, generally flat disc member having a top and a bottom face surface and an outer peripheral edge, a generally centrally disposed pin extending downwardly from the bottom surface and a window formed through the disc member between the top and bottom face surfaces adjacent to the outer peripheral edge, a second thin, generally fiat disc member having a top and a bottom face surface and an outer peripheral edge and having a pin receiving aperture, the pin received through the pin receiving aperture for relative rotation of the first and second disc members with the top face surface of the second disc member facing the bottom face surface of the first disc member, the pin extending a selected distance beyond the bottom surface of the second disc member for insertion into the ground, and stroke indicating indicia arranged on the top surface of the second disc member adjacent to the outer peripheral edge and selectively alignable with the window of the first disc member.

2. A combination ball marker and stroke indicator device according to claim 1 in which the first and second disc members are generally circular.

3. A combination ball marker and stroke indicator device according to claim 2 in which the top face surface of the second disc member has a diameter slightly less than the diameter of the bottom face surface of the first disc member.

4. A combination ball marker and stroke indicator device according to claim 3 in which the outer peripheral edge of the second disc member is tapered with the diameter of the second disc member decreasing relative to a direction going from the top surface to the bottom surface thereof.

5. A combination ball marker and stroke indicator device according to claim 2 in which the window in the first disc member is generally arcuate shaped.

6. A combination ball marker and stroke indicator device according to claim 2 in which the window in the first disc member is generally circular shaped.

7. A combination ball marker and stroke indicator device according to claim 2 further comprising a plurality of protrusions formed on the bottom surface of the second disc member for ground traction.

8. A combination ball marker and stroke indicator device according to claim 7 in which the plurality of protrusions are knurled.

9. A combination ball marker and stroke indicator device according to claim 7 in which the plurality of protrusions are rounded knobs.

10. A combination ball marker and stroke indicator device according to claim 7 in which the plurality of protrusions are conical knobs.

11. A combination ball marker and stroke indicator device according to claim 1 in which the pin and the pin receiving aperture are formed to provide an interference fit.

12. A combination ball marker and stroke indicator device comprising a first thin, generally circular flat disc member having a top and a bottom face surface and an outer peripheral edge, a generally centrally disposed pin extending downwardly from the bottom surface and a window formed through the disc member between the top and bottom face surfaces adjacent to the outer peripheral edge, a second thin, generally circular flat disc member having a top and a bottom face surface and an outer peripheral edge and having a pin receiving aperture, the pin received through the pin receiving aperture for relative rotation of the first and second disc members with the top face surface of the second disc member facing the bottom face surface of the first disc member, stroke indicating indicia arranged on the top surface of the second disc member adjacent to the outer peripheral edge and selectively alignable with the window of the first disc member, and a ground traction surface configuration comprising spaced apart protrusions extending downwardly from the bottom surface of the second disc member.

13. A combination ball marker and stroke indicator device according to claim 12 in which the protrusions are pointed knobs.

14. A combination ball marker and stroke indicator device according to claim 12 in which the protrusions are rounded knobs.

15. A combination ball marker and stroke indicator device according to claim 12 in which the protrusions of the ground traction surface configuration is knurled.

16. A combination ball marker and stroke indicator device comprising a first thin, generally circular flat disc member having a top and a bottom face surface and an outer peripheral edge, a generally centrally disposed pin extending downwardly from the bottom surface and a window formed through the disc member between the top and bottom face surfaces adjacent to the outer peripheral edge, a second thin, generally circular flat disc member having a top and a bottom face surface and an outer peripheral edge and having a pin receiving aperture, the pin received through the pin receiving aperture for relative rotation of the first and second disc members with the top face surface of the second disc member facing the bottom face surface of the first disc member, and stroke indicating indicia arranged on the ton surface of the second disc member adjacent to the outer peripheral edge and selectively alignable with the window of the first disc member, an annular recess being formed in one of the bottom face surface of the first disc member and the top face surface of the second disc member in alignment with the indicia to provide clearance between the indicia and the facing disc member.

17. A combination ball marker and stroke indicator device according to claim 16 in which the annular recess is formed in the bottom surface of the first disc member.

18. A combination ball marker and stroke indicator device comprising a first thin, generally circular flat disc member having a top and a bottom face surface and an outer peripheral edge, a generally centrally disposed pin extending downwardly from the bottom surface and a window formed through the disc member between the top and bottom face surfaces adjacent to the outer peripheral edge, a second thin, generally circular flat disc member having a too and a bottom face surface and an outer peripheral edge and having a pin receiving aperture, the pin received through the pin receiving aperture for relative rotation of the first and second disc members with the top face surface of the second disc member facing the bottom face surface of the first disc member, and stroke indicating indicia arranged on the top surface of the second disc member adjacent to the outer peripheral edge and selectively alignable with the window of the first disc member, an annular recess formed in the bottom surface of the first disc member aligned with the window, the recess being sufficiently wide as to extend beyond the top and bottom of the indicia on the second disc member when the second disc member is assembled onto the first disc member and the bottom face surface of the second disc member is formed with a ground traction surface configuration.

19. A combination ball marker and stroke indicator device according to claim 18 in which the outer peripheral edge of the second disc member is tapered with the diameter of the second disc member decreasing relative to a direction going from the top face surface to the bottom face surface thereof.

* * * * *